US005562398A

United States Patent [19]

Knutson

[11] Patent Number: 5,562,398

[45] Date of Patent: Oct. 8, 1996

[54] SKID STEER LOADER TILTABLE ATTACHMENT

[76] Inventor: Kenneth Knutson, Rte. 2, Box 57, Toronto, S. Dak. 57268

[21] Appl. No.: 368,891

[22] Filed: Jan. 5, 1995

[51] Int. Cl.[6] ..... E02F 3/76

[52] U.S. Cl. ..... 414/732; 414/685; 37/903

[58] Field of Search ..... 414/685, 689, 414/722–725, 732, 912; 37/379, 903

[56] References Cited

U.S. PATENT DOCUMENTS

| | | | |
|---|---|---|---|
| 3,539,022 | 11/1970 | Berg | 172/805 |
| 4,328,628 | 5/1982 | Thomas | 414/912 |
| 4,512,090 | 4/1985 | Billings | 414/912 |
| 4,540,330 | 9/1985 | Taylor | 414/620 |
| 4,718,814 | 1/1988 | Addlemann | 414/705 |
| 4,906,161 | 3/1990 | Weyer | 414/705 |
| 4,999,022 | 3/1991 | Veys | 414/912 |
| 5,087,168 | 2/1992 | Mckinnon et al. | 414/687 |
| 5,114,299 | 5/1992 | Roche et al. | 414/912 |
| 5,165,191 | 11/1992 | Davis | 414/912 |
| 5,281,076 | 1/1994 | Lehman | 414/607 |
| 5,403,144 | 4/1995 | Staben, Jr. | 414/697 |

OTHER PUBLICATIONS

"Tink Hydra–Tilt Frame", Jan. 5, 1995, 1 page.

*Primary Examiner*—Karen B. Merritt
*Assistant Examiner*—Gregory A. Morse

[57] ABSTRACT

A tiltable attachment is provided for a Skid Steer Loader. The tiltable attachment is secured to the loader arms of the Skid Steer Loader and receives and fastens the utility attachment of the Skid Steer Loader. The tiltable attachment including a mounting base member and a pivotal attachment member. These members being rotated by a power cylinder. The pivotal attachment member has a demountable cover plate. The pivotal attachment member will receive the commonly known utility attachments. The tiltable attachment maintains the ability of the Skid Steer Loader to move the utility attachments in the vertical and horizontal plains while further providing the ability to rotate the utility attachment around the longitudinal axis of the Skid Steer Loader.

22 Claims, 6 Drawing Sheets

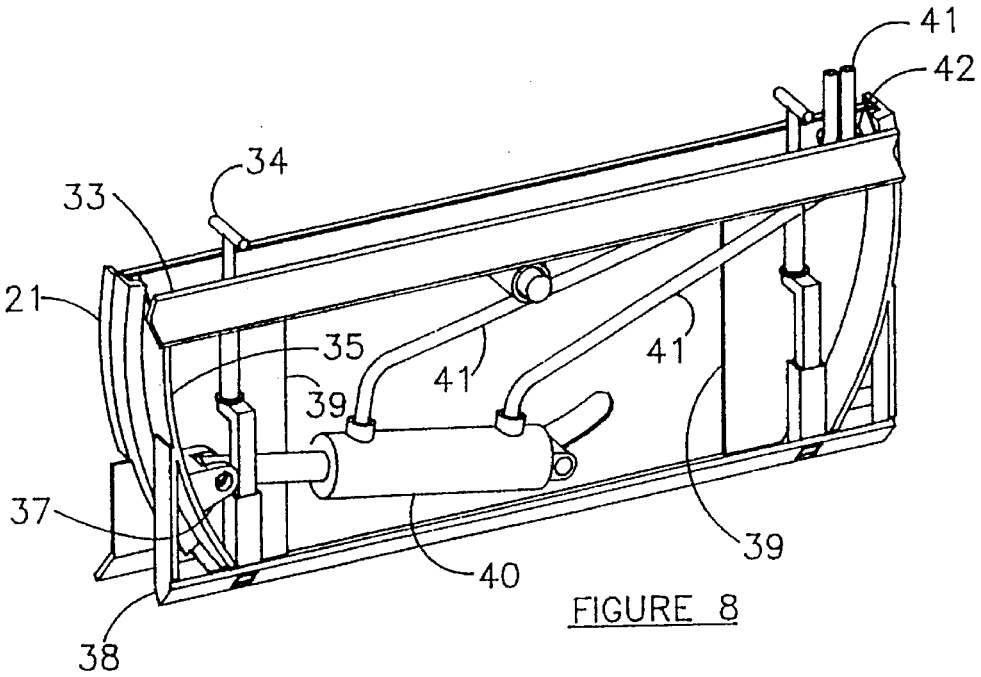
FIGURE 8
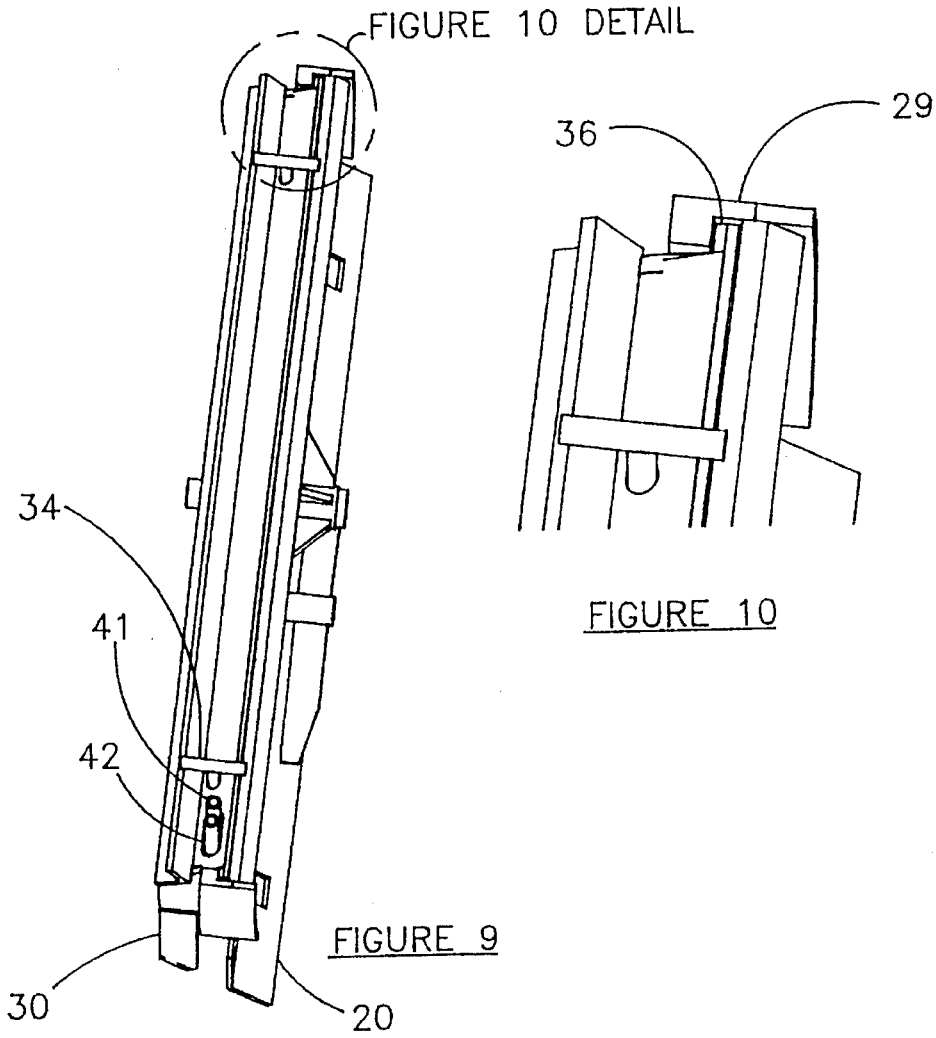
FIGURE 10
FIGURE 9

SKID STEER LOADER TILTABLE ATTACHMENT

BACKGROUND

1. Field of the Invention

This invention pertains to a tiltable attachment for skid steer loaders. More particularly, this invention pertains to tiltable attachment which enables bucket attachments for skid steer loaders to be rotated around the longitudinal axis of the skid steer loader arms.

2. Description of the Prior Art.

In the related art many attachments exist for rotating utility attachments around the horizontal axis of the skid steer loader arms. See for example, U.S. Pat. Nos. 3,512,283 and 3,539,022.

These constructions emphasize the rotating of the utility attachments while they are engaging the ground. This type of device allows for the up and down movement of the utility attachment around the horizontal axis and side to side movement of the utility attachment around the vertical axis.

Their primary purpose is to dispose of material being gathered in front of the utility attachment to the side. The devices do not posses the strength to vertically raise the material being pushed and subsequently rotate the material around the longitudinal axis allowing the material to be dumped to either side while elevated around the vertical axis.

In other related art many attachments exist for rotating utility attachment loads. See for example, U.S. Pat. Nos. 4,5540,330 and 5,281,076.

These constructions emphasize the lifting and rotating of containerized loads. This type of device allows for the up and down movement of the containers around the horizontal axis and the rotation of the containers around the longitudinal axis. They do not allow for the lifting and rotation of loose materials. Further these devices do not possess the strength to push material while rotated. These devices are designed for very specialized use. Their utility attachments are generally constructed to accept only specific types of containers.

The need for a device with the strength to operate while rotating around the horizontal, vertical and longitudinal axis has been known. The method for providing the strength to allow such rotation is not known.

SUMMARY

The present invention has for its main objective to provide strength to allow the operator to rotate around the horizontal, vertical and longitudinal axis during operations with utility attachments for skid steer loaders. This strength is provided by means of a mounting base member and a corresponding pivotal attachment member. The said mounting base member and pivotal member have interposed rocker arms providing exceptional strength to this invention.

BRIEF DESCRIPTION OF THE DRAWINGS

FIG. 8 is a front perspective view of the skid steer loader tiltable attachment with the power cylinder mounted and the demountable cover plate demounted.

FIG. 9 is a plan view of the mounting base plate and the pivotal attachment plate assembled of the skid steer loader tiltable attachment.

FIG. 10 is an enlarged, plan view of the insertion of the mounting base plate's inner rocker guide member and the pivotal attachment plate's inner rocker flange member of the skid steer loader tiltable attachment.

DETAILED DESCRIPTION

Figure 1:
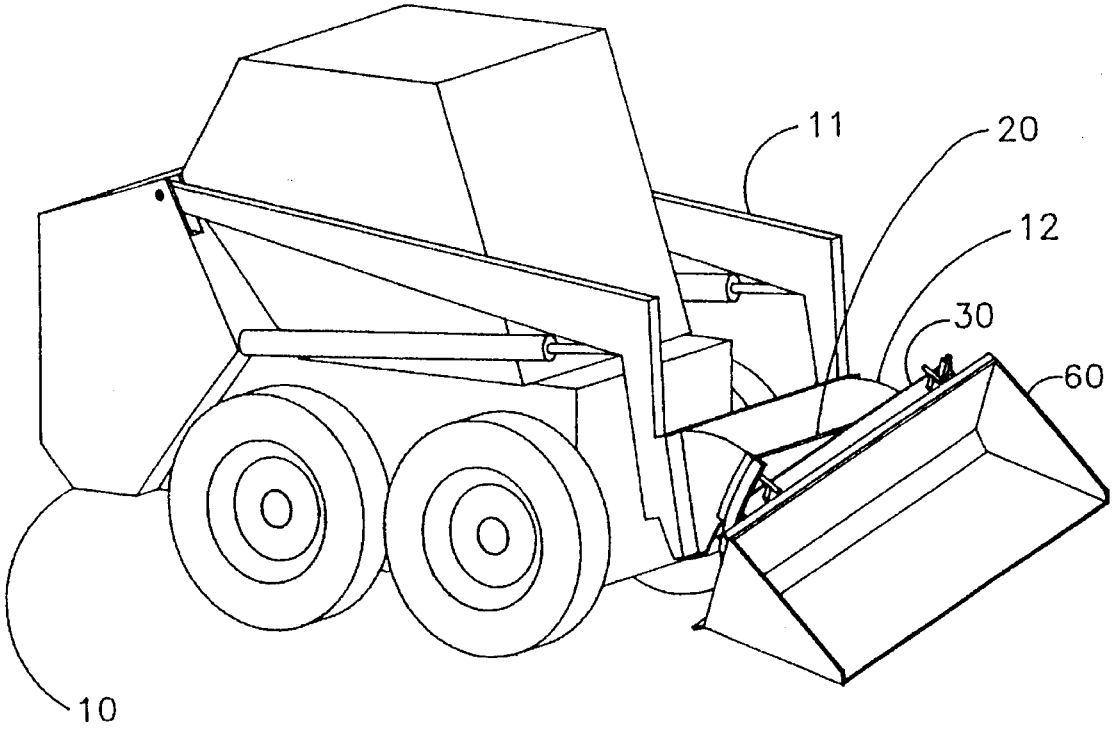
FIG. 1 is a side perspective view of a conventional skid steer loader with the tiltable attachment mounted between the loader arms and the utility attachment.
Figure 2:
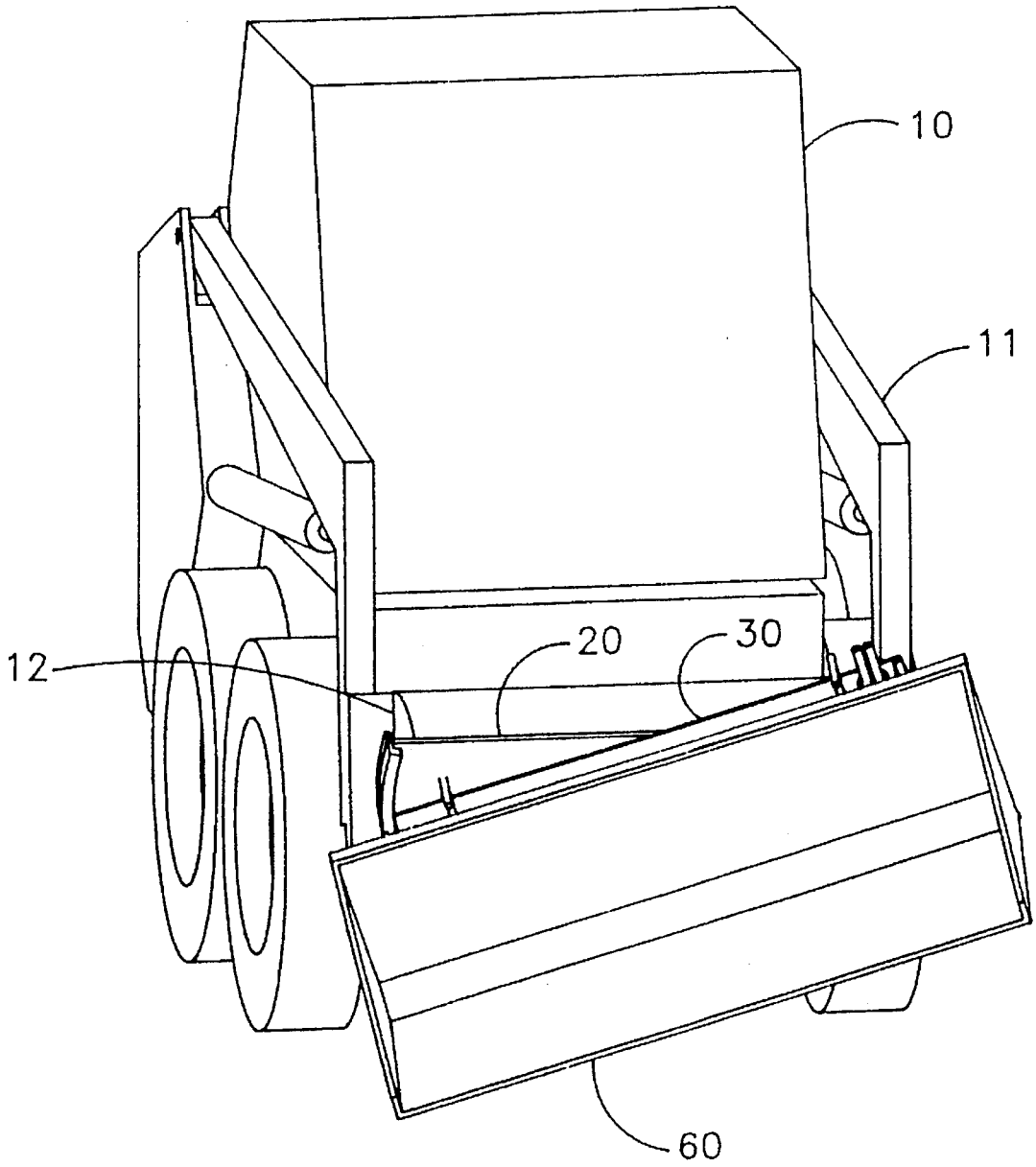
FIG. 2 is a front perspective view of a conventional skid steer loader with the tiltable attachment mounted between the loader arms and the utility attachment.
Figure 3:
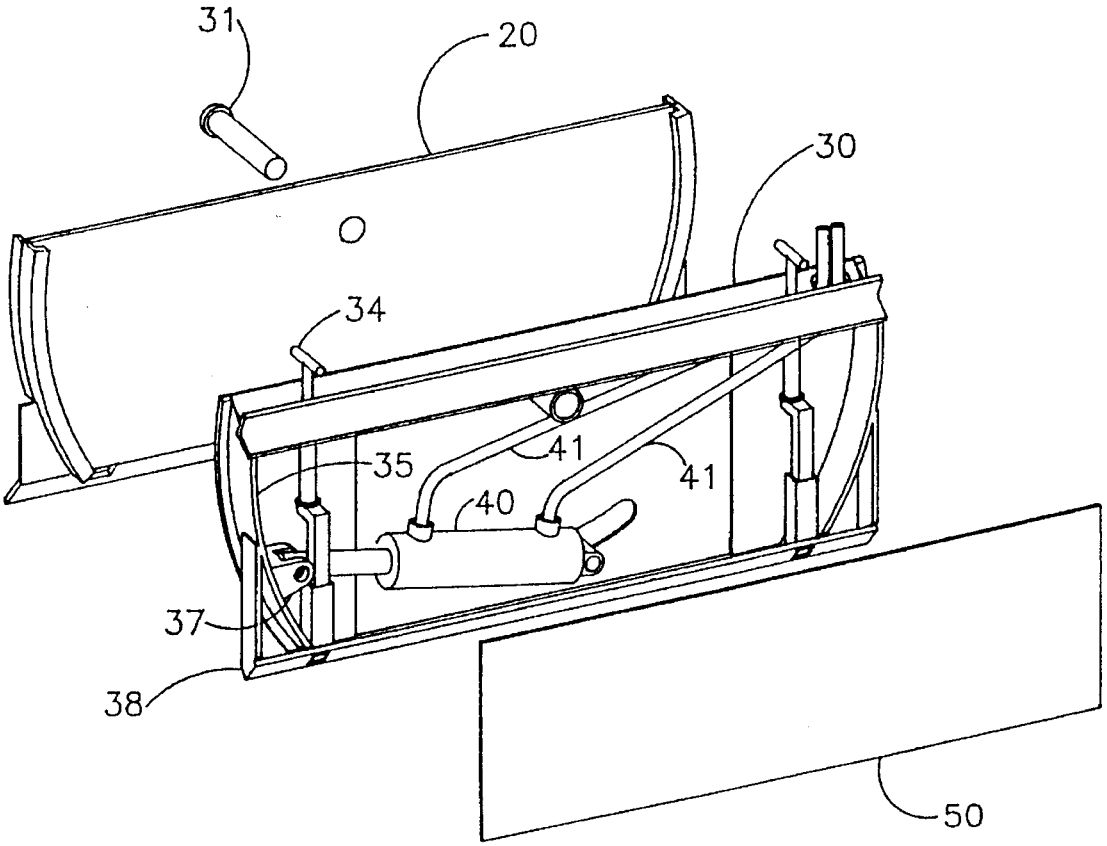
FIG. 3 is a frontal exploded view of the skid steer loader tiltable attachment.
Figure 4:
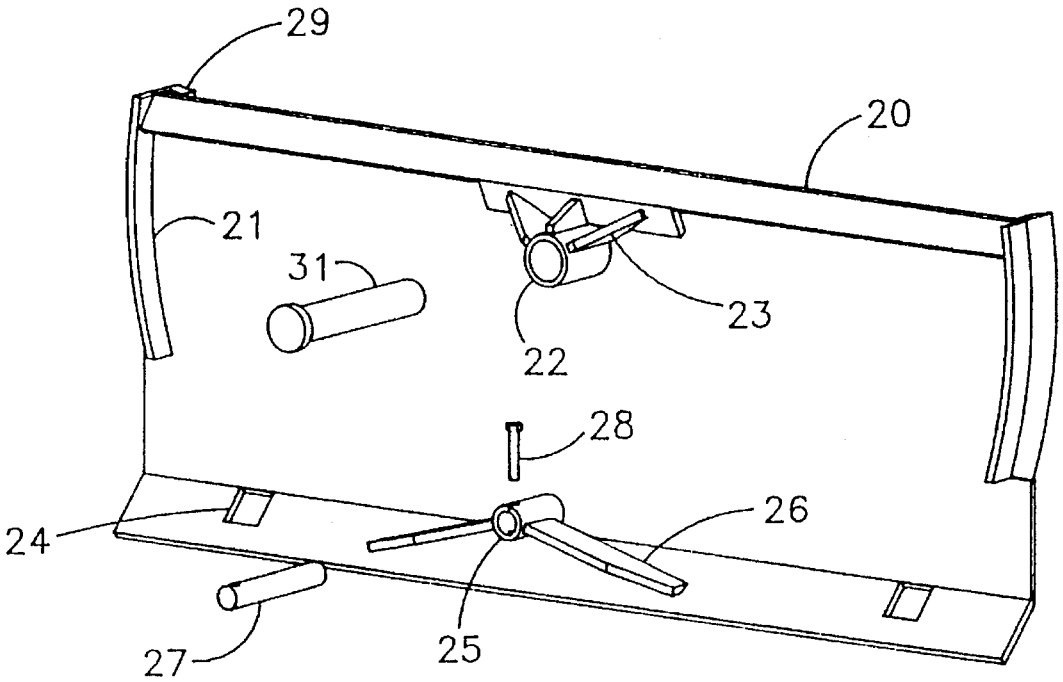
FIG. 4 is a rear perspective view of the mounting base member of the skid steer loader tiltable attachment.
Figure 5:
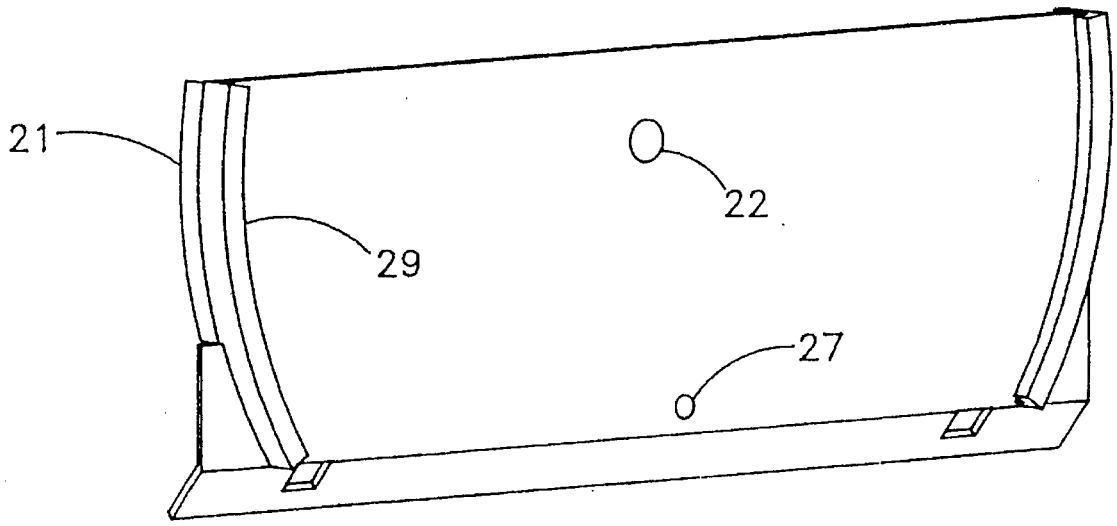
FIG. 5 is a front perspective view of the mounting base member of the skid steer loader tiltable attachment.
Figure 6:
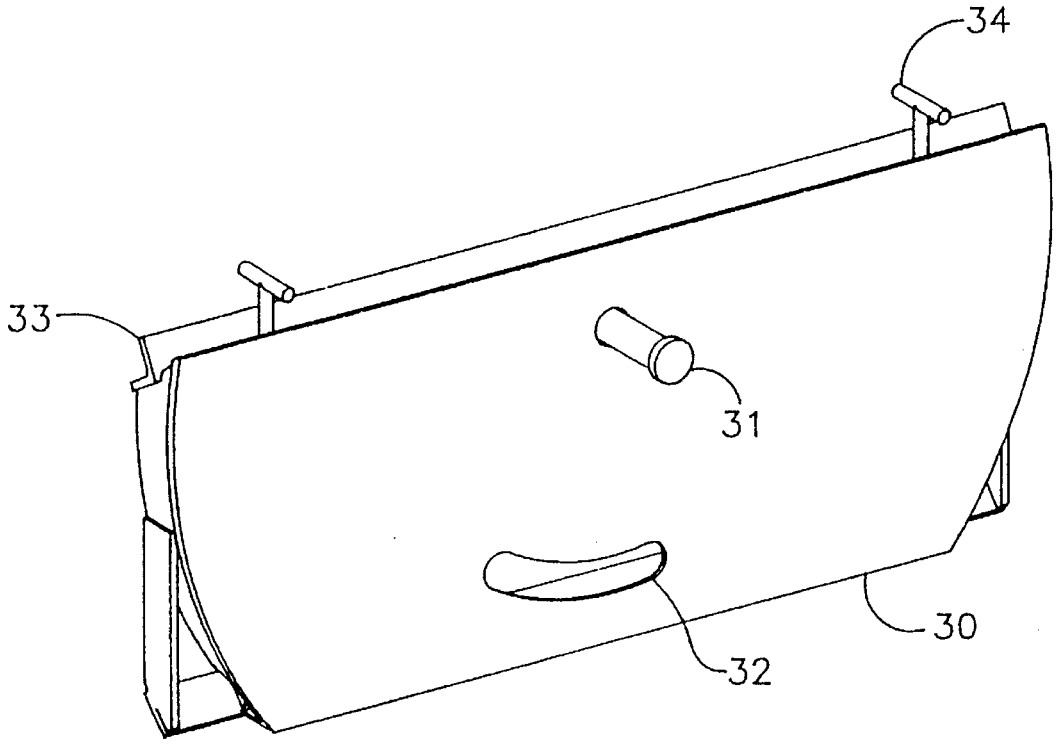
FIG. 6 is a rear perspective view of the pivotal attachment member of the skid steer loader tiltable attachment.
Figure 7:
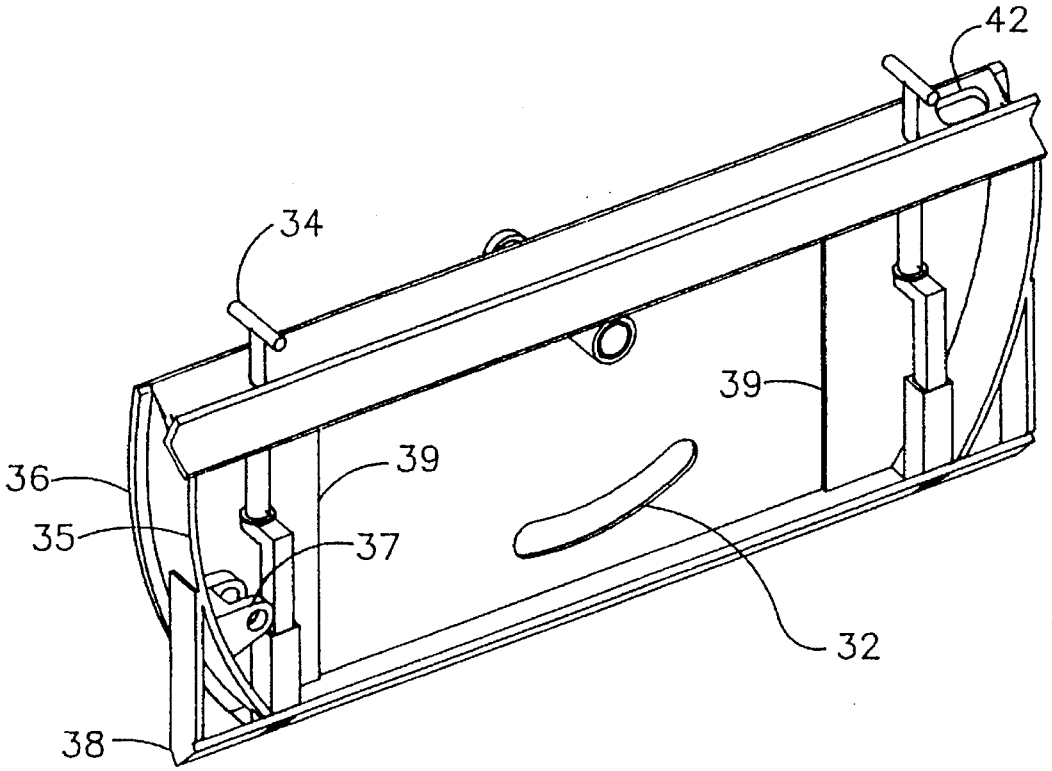
FIG. 7 is a front perspective view of the pivotal attachment member of the skid steer loader tiltable attachment.

For purposes of illustration, the invention has been shown in the drawings as embodied in a bucket utility attachment 60 for use with a vehicle 10 of the type conventionally known as a skid steer loader. The vehicle 10 includes a pair of parallel loader arms 11 spaced to mount on the outside rear of vehicle 10. These arms arm mounted such that they can move the non-mounted end of the loader arms 11 in an up and down direction around the horizontal axis formed by the rear mounting of the loader arms 11.

The non-mounted loader arms 11 ends terminate in a loader arm engaging member 12 which attaches to the mounting base plate 20 which engages the pivotal member 30 which attaches to the utility attachment 60. The invention functions in all perspectives as the standard skid steer loader in attachment methods, utility attachment 60 operation, and vehicle 10 operation.

The tiltable attachment enhances the above stated operation of the utility attachment 60 by providing the strength for utility attachment 60 operation in rotational displacement in the horizontal, vertical, and longitudinal planes. The pivotal member 30 can move in concert with the mounting base member 20 in the vertical plane by raising and lowering the loader arms. The pivotal member 30 can move relative to the mounting member in a horizontal plane about a longitudinal axis allowing the pivotal member 30 to have six way moving capability as opposed to four way movement. This invention is composed of two interposed members, a mounting base member 20 and a pivotal member 30.

The mounting base member 20 attaches to the loader arm engaging member 12 secured through the mounting guide slots 24. The mounting requirements for base member 20 are dictated by the loader arm engaging member 12 which differ by manufacture and model.

The mounting base member 20 has a pivotal tube member 22 and a power cylinder tube member 25. The pivotal tube member 22 is reinforced with pivotal tube reinforcing gussets 23. The power cylinder tube member 25 is reinforced with power cylinder tube reinforcing member 26. Inserted into the pivotal tube member 25 is the power cylinder shaft member 27. The power cylinder shaft member 27 is locked in the power cylinder tube member 25 by the shaft locking device 28.

The mounting base member has outer rocker members 21 starting at the top outer edge of each side and arching down to the bottom edge of the mounting base member 20. The outer rocker member 21 has a inner rocker guide member 29 into which the inner rocker flange member 36 of the inner rocker member 35 of the pivotal attachment member 30 is supported.

The pivotal attachment member 30 has reinforcing plates 39 welded to its outer surfaces. The pivotal attachment member 30 has a pivotal shaft member 31 mounted such that it engages the pivotal tube member 22 of the mounting base member 20. The engaging bucket beam 33 is mounted on the forward top of the pivotal attachment member 30 while the engaging utility attachment handle 34 is mounted in and passes through the pivotal attachment member 30. The power cylinder shaft passage 32 allows the passage of the power cylinder shaft member 32 through the pivotal attachment member 30.

The pivotal attachment member 30 has a power cylinder mounted 37 to which one end of a power cylinder 40. The other end of the power cylinder 40 is mounted to the power cylinder shaft member 27 which is inserted through the power cylinder shaft passage 32 . The power cylinder 40 has power cylinder hoses 41 which exit the pivotal attachment member 30 through the power cylinder hose opening 42.

The cover mounting brackets 38 are welded to the out side lower corners of the pivotal attachment member 30. The demountable cover plate 50 demountably attaches to the cover mounting brackets 38 and the forward edge of the cavity created by the inner rocker members 35 and the base of the pivotal attachment member 30.

What is claimed is :

1. A skid steer loader comprising:

a wheeled vehicle having a pair of loader arms mounted to raise and lower in the vertical plane;

said loader arms having non-mounted ends terminating in a loader arm engaging member;

said loader arm engaging member demountably engaged to a mounting base member including opposing outer supporting rocker members;

said mounting base member rotatively coupled by a pivotal shaft member to a pivotal attachment member including an inner rocker member supported on said outer supporting rocker member; and said pivotal attachment member detachably attached to a utility attachment.

2. An attachment according to claim 1 wherein said pivotal member rotates about a longitudinal axis.

3. An attachment according to claim 1 wherein movement of said pivotal attachment member is six way.

4. An attachment according to claim 3 wherein said six way movement is caused by a motive power.

5. A skid steer loader comprising:

a wheeled vehicle having a pair of loader arms mounted to raise and lower in the vertical plane;

said loader arms having non-mounted ends terminating in a loader arm engaging member;

said loader arm engaging member demountably engaged to a mounting base member;

said mounting base member including a pivotal tube member and an outer supporting rocker member;

said pivotal tube member rotatively coupled to a pivotal shaft member;

said pivotal shaft member including a pivotal attachment member and an inner rocker member;

said inner rocker member supported on said outer supporting rocker member; and said pivotal attachment member detachably attached to a utility attachment.

6. An attachment according to claim 5 wherein said pivotal member rotates about a longitudinal axis.

7. An attachment according to claim 5 wherein a motive power for said pivotal attachment member rotation is supplied by a power cylinder.

8. An attachment according to claim 5 wherein said mounting base member includes a power cylinder shaft member.

9. An attachment according to claim 8 wherein said power cylinder shaft member is removabley secured in a power cylinder tube member.

10. An attachment according to claim 5 wherein said pivotal member includes a power cylinder shaft passage and a power cylinder mount.

11. An attachment according to claim 7 wherein said power cylinder connects said power cylinder shaft passage and said power cylinder mount.

12. An attachment according to claim 5 wherein said pivotal member includes a cover mounting bracket supporting a demountable cover plate.

13. A skid steer loader comprising:

a wheeled vehicle having a pair of loader arms mounted to raise and lower in the vertical plane;

said loader arms having non-mounted ends terminating in a loader arm engaging member;

said loader arm engaging member demountably engaged to a mounting base member;

said mounting base member including outer supporting rocker members;

said outer supporting rocker members supportably engaging inner rocker members of a pivotal member; and said pivotal member being detachably attached to a utility attachment.

14. An attachment according to claim 13 wherein said pivotal member moves in a six way manner.

15. An attachment according to claim 13 wherein the motive power for said pivotal member rotation is a power cylinder.

16. An attachment according to claim 13 wherein said mounting base member includes a power cylinder shaft member.

17. An attachment according to claim 13 wherein said power cylinder shaft member is removable secured in a power cylinder tube member.

18. An attachment according to claim 13 wherein said pivotal member includes a power cylinder shaft passage and a power cylinder mount.

19. An attachment according to claim 12 wherein said power cylinder connects said power cylinder shaft passage and said power cylinder mount.

20. An attachment according to claim 13 wherein said pivotal member includes a cover mounting bracket supporting a demountable cover plate.

21. An attachment according to claim 13 wherein said outer rocker member includes an inner rocker member guide.

22. An attachment according to claim 21 wherein said inner rocker member mounts within said inner rocker member guide of said outer rocker member.

* * * * *